US006837445B1

(12) United States Patent
Tsai

(10) Patent No.: US 6,837,445 B1
(45) Date of Patent: Jan. 4, 2005

(54) INTEGRAL PUMP FOR HIGH FREQUENCY ATOMIZER

(76) Inventor: Shirley Cheng Tsai, 5702 Highgate Ter., Irvine, CA (US) 92612

( * ) Notice: Subject to any disclaimer, the term of this patent is extended or adjusted under 35 U.S.C. 154(b) by 0 days.

(21) Appl. No.: 10/747,666

(22) Filed: Dec. 29, 2003

Related U.S. Application Data

(63) Continuation of application No. 09/944,643, filed on Aug. 30, 2001, now Pat. No. 6,669,103.

(51) Int. Cl.[7] ..... B05B 1/08

(52) U.S. Cl. ..... 239/102.2; 239/101; 239/102.1; 239/533.12; 239/337; 239/338; 239/585.1

(58) Field of Search ..... 239/101, 102.1, 239/102.2, 337, 338, 533.12, 583, 585.1; 310/323, 325, 328

(56) References Cited

U.S. PATENT DOCUMENTS 3,114,654 A * 12/1963 Nishiyama et al. ..... 239/102.2
3,131,515 A * 5/1964 Mason ..... 310/323.01
4,019,683 A * 4/1977 Asai et al. ..... 239/102.2
4,173,725 A * 11/1979 Asai et al. ..... 310/325
4,271,100 A 6/1981 Trassy
4,350,302 A 9/1982 Gruber et al.
4,691,724 A * 9/1987 Garcia et al. ..... 310/325
4,799,622 A 1/1989 Kokubo et al.
4,808,084 A * 2/1989 Tsubouchi et al. ..... 310/328
4,978,067 A 12/1990 Berger et al.
5,152,457 A * 10/1992 Burwell et al. ..... 239/102.2
5,687,905 A * 11/1997 Tsai ..... 239/4
6,669,103 B2 * 12/2003 Tsai ..... 239/4

* cited by examiner

*Primary Examiner*—Robin O. Evans
(74) *Attorney, Agent, or Firm*—David T. Bracken

(57) ABSTRACT

The present invention comprises a nozzle type atomizer with two or more aligned "horn" stages. The definition of a "horn" stage is well known in the prior art as an effectively half wavelength length and a tapering shape with a central conduit. The present invention uses two to five, or more, horn stages integrally attached end to end. The dramatic improvement in amplitude of the vibration at the tip of the nozzle is without precedence in the prior art. The present invention makes application of transducer vibration at greater than 200 kHz possible. The present invention reduces the required applied energy for generating the necessary amplitude at the tip by the discovery of amplitude multiplication with two or more horn stages.

9 Claims, 6 Drawing Sheets

INTEGRAL PUMP FOR HIGH FREQUENCY ATOMIZER

This application is a continuation in part of Ser. No. 09/944,643 filed Aug. 30, 2001 now U.S. Pat. No. 6,669, 103.

The present invention relates to an handle part of a device used in the production of droplets by application of ultrasonic vibration to the end of one or more nozzles from which a liquid or slurry jet exits.

BACKGROUND OF THE INVENTION

Producing droplets of predictable size within a narrow droplet size distribution has been the admirable goal of many prior art attempts. Heat and mass transfer characteristics, as well as other process parameters, change significantly for droplets within the range of diameters typically produced by many prior art devices. Process calculations for modeling such processes with wide droplet size distribution must be subdivided into size groupings and require sophisticated computer-based solutions. Actual operation of processes with wide droplet size distribution generally produces results which are less stable and less predictable than those in which droplet size is effectively narrowed.

Capillary wave atomization is done with two general types of devices. U.S. Pat. No. 5,687,905 shows one of the types, the nozzle type, where liquid runs through a conduit inside a metal cone a tip. The nozzle consists of a transducer located at a node in the nozzle axis and rigidly connected with two separated masses, where each mass is located on opposite axial sides from the transducer for vibrating the cone at a resonant frequency of less than about 200 kHz. In conventional nozzle type ultrasonic atomizers, the liquid is fed into an atomizing nozzle and then flows through or over a piezoelectric transducer and horn, which vibrate at ultrasonic frequencies to produce short wavelengths that atomize the liquid. U.S. Pat. No. 5,152,457 discloses that conventional ultrasonic atomizing nozzles incorporate a low-frequency electrical input from 25 to 120 kHz, two piezoelectric transducers, and a horn to produce weight mean droplet diameters in the range of 25 to 100 microns. Other conventional ultrasonic atomizers of the nebulizer type have been used in medical applications to produce droplets in the range of 1 to 5 microns.

It has been found that operation of transducers at about 200 kHz or above for prior art nozzle type atomizers causes so much heating that system failure will result with prolonged use. Without the resonant air assistance of U.S. Pat. No. 5,687,905, extremely small drops can't be made with the nozzle type atomizers due to low (less than 200 kHz) frequency that may be applied to those nozzles. Nozzle lengths were found require an effective longitudinal length equal to one half wavelength of the longitudinal wave to produce a maximum amplitude at the tip. A nozzle type device that has been long available is the ultrasonic nozzle (Sono-Tek Model 8700-120, Milton, N.Y.) with a central channel (0.93±0.02 mm diameter) for liquid flow. The Sono-Tek ultrasonic nozzle consists of a pair of washer-shaped ceramic (PZT) piezoelectric transducers and a titanium resonator. The transducers, surrounding the central channel, are sandwiched in the titanium resonator located in the large diameter (about 3.6 cm) portion of the nozzle body. The piezoelectric transducers receive an electrical input at the nozzle resonant frequency from a broadband ultrasonic generator (Sono-Tek Model 06-05108), and convert the input electrical energy into mechanical energy of vibration. The nozzle is a half wavelength design with a resonant frequency (f) of 120 kHz. It is geometrically configured such that excitation of the piezoelectric transducers creates a standing wave through the nozzle, with the maximum vibration amplitude occurring at the nozzle tip. The outside diameter of the nozzle tip and the length of the front horn measure 3.12 mm and 1.4 cm, respectively. As a liquid jet issues from the nozzle tip, a liquid capillary wave is initiated by the ultrasound. The capillary wave travels axially along the jet in the direction of the liquid flow, and its amplitude grows exponentially due to amplification by the air blowing around it. Atomization occurs when the amplitude becomes too great to maintain wave stability. It is known to make a single horn stage nozzle having a single cone and an overall length in multiple half wavelengths, although it is also well known that the nozzle tip surface area is dramatically reduced by such multiplication of half wavelengths in the overall length.

The other capillary wave atomizer is the nebulizer type. U.S. Pat. No. 4,271,100 shows such a type. Its transducer operates at 200 kHz to 10 MHz. However, liquid has to be delivered to a vibrating surface. The advantage of the nebulizer type is clear. The higher operating frequency produces much smaller drops than those possible from the nozzle type (without the air assistance of U.S. Pat. No. 5,687,905). However, the nebulizer type requires a large energy input to generate its smaller drops and to improve surface area for atomization many strange configurations have been proposed in the prior art, such as those of U.S. Pat. Nos. 4,978,067, 4,726,522 and 4,350,302.

The capillary wave mechanism of ultrasonic atomization of a liquid jet in the nozzle type has been well accepted since its first demonstration in about 1962. Specifically, capillary waves are formed in the liquid film of a pressurized, flowing liquid stream contacting a solid surface that is vibrating at frequencies from 10 kHz to less than 200 kHz. An increase in the vibrational amplitude of a vibrating surface results in a proportional increase in the amplitude of the liquid capillary waves in the liquid film. An adequately designed ultrasonic atomizer will maintain contact between the vibrating solid surface and the flowing liquid stream until a wave amplitude is developed in the liquid film contacting the solid surface sufficient to cause atomization at some point after the liquid is no longer in contact with the vibrating surface. The vibrating solid surface is the inside of a tube through which the pressurized, flowing liquid stream moves, wherein the tube vibrates substantially parallel to the flow of the liquid stream.

Atomization in ultrasonic atomizers occurs when (1) the vibration amplitude of the solid surface increases the amplitude of the capillary waves of the liquid stream film above a level at which wave stability cannot be maintained and (2) the pressurized, flowing liquid stream is expanded into a lower pressure gas, as the continuous phase, of sufficient volume and/or flow rate to permit desired droplet formation. The resulting median drop size from ultrasonic atomizers is proportional to the wavelength of the capillary waves which is, in turn, determined by the ultrasonic frequency in accordance with the Kelvin equation.

There is a complete absence in the prior art of nozzle type atomization at and above 200 kHz due to mechanical and heating constraints. The present invention overcomes that limitation.

SUMMARY OF THE INVENTION

The present invention comprises a nozzle type atomizer with two or more aligned "horn" stages as its ultrasonic resonator. The definition of a "horn" stage is well known in the prior art as an effectively half wavelength length and a tapering shape cone with a central conduit. The present invention uses two to five, or more, horn stages integrally attached end to end. The dramatic improvement in amplitude of vibration at the tip of the nozzle is without precedence in the prior art. The present invention makes application of transducer vibration at greater than 200 kHz possible. The present invention reduces the required applied energy for generating the necessary capillary wave at the tip by the discovery of amplitude multiplication with two or more horn stages. The more specific example below and the drawing figures show this unexpected amplification in more detail.

The generally tapering shape of a horn stage means that cross section mass is reduced toward its distal end. At the start of the next integrally attached horn stage, the cross section mass is relatively suddenly increased to an effective inertial mass. The shape of the cross sections of the horn stages has been made effective by the present invention in both conical and substantially rectangular cross sections.

The preferred material of the horn stages is silicon or glass and similar composites and compounds of silicon effective for the objects of the present invention.

The transducer location in the invention may be at a flat side of a base section, embedded within the base section or affixed to a base of the base section. Thus, the invention can have one to four transducers in separated locations. The transducers include those with a single layer as well as the types that are electrically parallel and mechanically serial layout. The invention embodiments with more than one separated transducer are adapted to have effective electrical connection to a power supply where all transducers operate at an identical resonant frequency in coordination to produce capillary wave atomization.

The present invention is also a method of obtaining drops in the size typical of the operation of nebulizer types although from a nozzle type device.

The present invention is a method for nozzle type devices to operate at and above about 200 kHz.

In my previous disclosure under application Ser. No. 09/944,643 filed Aug. 30, 2001, a nozzle type atomizer was formed by connecting sequential "horn" stages as the ultrasonic resonator for the atomizer. The horn stages have relatively wide inlet portions narrowing to much smaller nodal outlets. While this device is extremely effective in atomizing, only prior art liquid pumps or liquid supply were known at the time to deliver liquid to the inlet of the first horn stage. Such pumps seemed to the inventor to be unduly expensive and inadequately designed for the small and constant liquid flows desired. The present improvement is a pump integral with the device of application Ser. No. 09/944,643 filed Aug. 30, 2001.

The invention pump uses one or more horn stages with reverse orientation compared with the forward horn stages. However, the pump stages are integral with one end of a two-ended transducer driver section. The second end of the driver section is integral with the forward horn stages. Thus, a side view of the entire device would generally look as if a right hand set of horn stages were pointed right, a left hand set of horn stages were pointed left and the two sets of horn stages were supported from a driver stage. One set of horn stages (pump horn stage section) is in contact with the liquid supply and serves as a pump while the set of forward horn stages serve as an atomizer; liquid runs continuously along a common axis of the pump horn section, the driver section, and forward horn stages section. When the transducer is turned on, the pump horn stages are energized by atransducer in the driver section with the same applied frequency as those of the forward horn stages. Energizing the pump stages generates negative liquid pressure at the tip of the pump horn stage section, drawing liquid into the device at a supply rate and operational frequency complementary to the atomization capability of the device as a whole. In short, the liquid volume supplied by the invention pump essentially matches the atomization liquid demand.

DETAILED DESCRIPTION OF THE INVENTION

Figure 1:
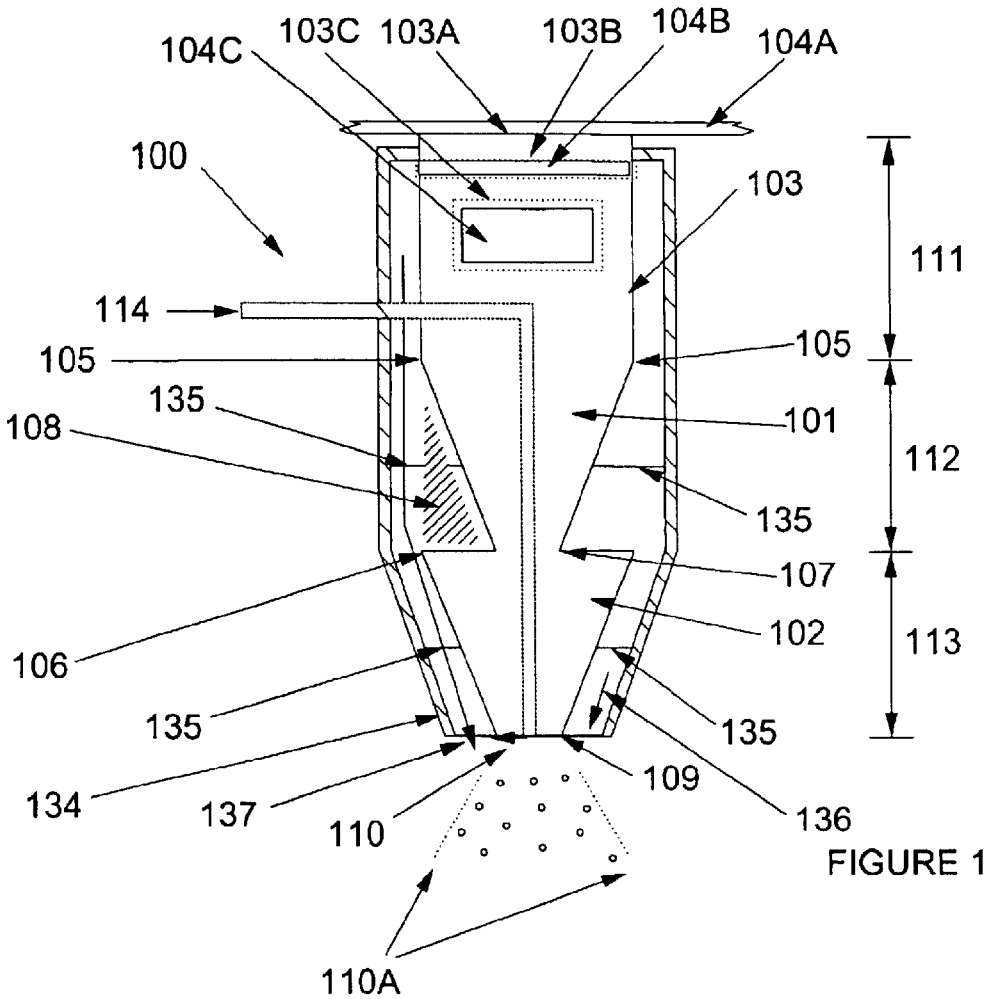
FIG. 1 is a side view of the invention device with two generalized horn stages joined tip to base.

The invention is now discussed with reference to the Figures. FIG. 1 shows a generalized form of an invention nozzle with two horn stages as embodiment 100. A connector base section 103 is a preferred location for transducers in one or more of the locations described above. Section 103 is also a preferred location for connection to a conduit 114 that feeds liquid to a base section opening of conduit 114 for delivery of liquids to the nozzle tip surface 109.

Connector base section 103 can be tapered to provide additional amplitude magnification, as described below. However, as shown in FIG. 1, connector base section 103 is un-tapered and has substantially straight sides with respect to the axis of the nozzle, providing little amplification for the tranducer-supplied vibration. The axis of a nozzle is approximately the center of the liquid conduit leading to the nozzle tip.

Connector base 103 may have a transducer 104A effectively connected with a base 103A or a transducer 104B embedded in location 1038, each adapted to operate in a longitudinal mode. Connector base 103 may have a transducer 104C effectively connected with a flat side 103C of a connector base 103 with a rectangular cross section across the nozzle axis, adapted to operate in a transverse mode. Transducers 104A, 104B or 104C may each separately operate the nozzle to obtain the objects of the invention, although operating more than one transducer at a time increases energy delivery to the nozzle. Operation of transducer 104A can assist in actuating liquid movement through conduit 114.

In a preferred embodiment, invention nozzles are located side by side, preferably relatively closely, with the bases of their connector base sections effectively attached to a single transducer. The side by side arrangement thus produces an array of the invention nozzles which cumulatively emit the fine drops in greater numbers than a single nozzle. Where a single invention nozzle may produce sufficient numbers of drops for liquid medication atomization, an array of the invention nozzles produces sufficient drops over time for other applications as described herein. As for the embodiment of FIG. 1 adapted to form a part of an array, transducer 104A would effectively extend its plane so that other nozzles could be attached to it to operate at the same ultrasonic frequency.

Further describing FIG. 1, a top of connector base section 103 is integrally attached to a base 105 of horn stage 101, which in turn is connected at its distal tip 107 to the base section 106 of horn stage 102. Nozzle tip surface 109 receives liquid flowing from conduit 114 through the base section 103, horn stage 101, horn stage 102, out the exit port of tip surface 109 and along its surface in direction 110 to wet the substantially lateral surface area. It is understood in the art that proper operation of nozzle type ultrasonic atomization is accomplished across the entire wetted cross section of tip 109 including the exit port from the internal conduit. In this way, even though the conduit opening does not provide a solid transmission surface for generating capillary waves normal to that opening, the adjacent solid surfaces provide that wave transmission. A mist of drops 110 is emitted from the liquid surface on tip 109.

Figure 5:
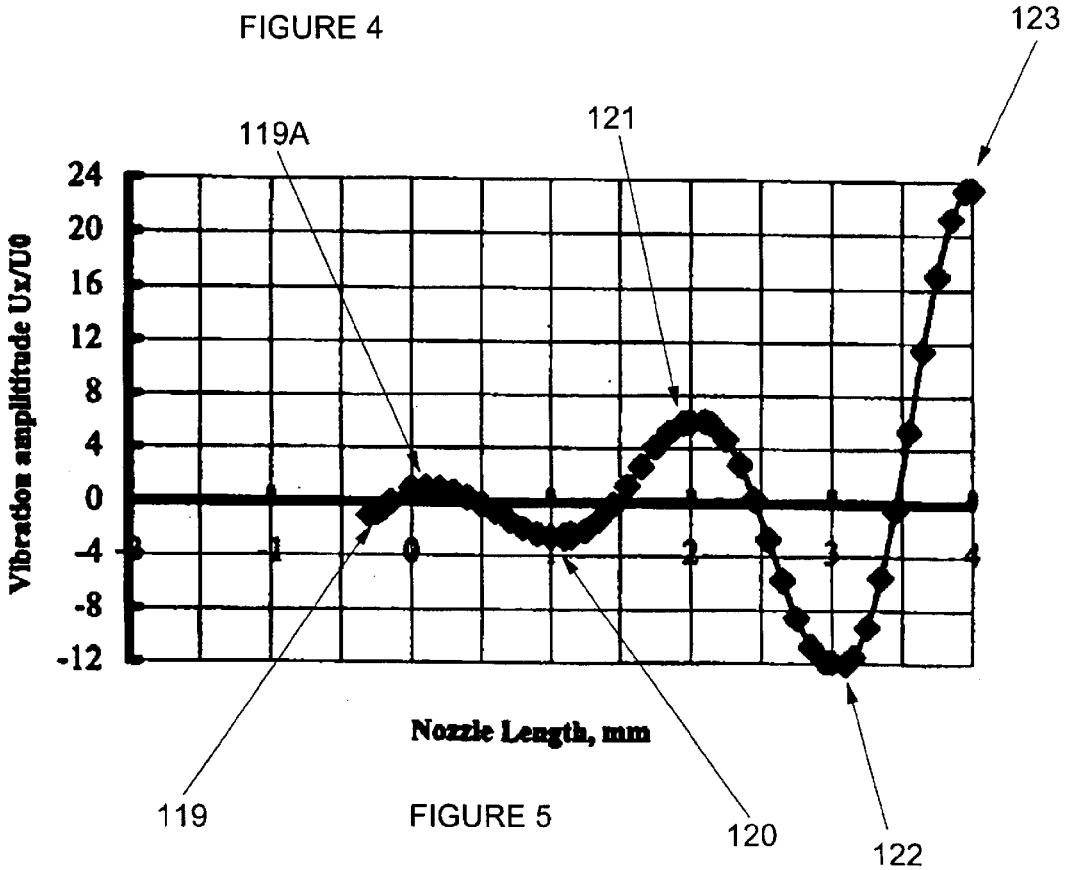
FIG. 5 is a graph of amplitude increasing at each horn stage of a 4 horn stage embodiment of the invention.

FIG. 1 shows that base section 103, horn stage 101 and horn stage 102 have respective lengths 111, 112 and 113. These lengths are optimized for the ultrasonic frequency to be applied through the transducer(s) to the invention nozzle. These lengths are shown in FIG. 5 for an invention nozzle made of silicon for operation at 5 MHz as the distances between points 119 to 119A, 119A to 120, and 120 to 121 for respective lengths 111, 112 and 113. The lengths indicated for distances between points 121 to 122 and 122 to 123 correspond to the additional two horn stages of an invention nozzle having 4 horn stages and the vibration amplitude that will be obtained at the nozzle tip when the invention nozzle is operated at a resonant frequency of 5 MHz.

In ultrasound modulated two fluid atomization, a liquid capillary wave (transverse wave with frequency half of ultrasound frequency) is initiated by the ultrasound as the liquid jet issues from the nozzle tip that vibrates at the same frequency as the ultrasound. The capillary wave travels axially along the jet in the direction of the liquid flow with its amplitude growing exponentially due to amplification by air blowing around it. Atomization occurs when the amplitude of the capillary wave becomes too great to maintain wave stability. The resulting peak drop diameter (the drop diameter where the peak of a drop-size distribution occurs) was found to equal the wavelength of the capillary wave calculated by the Kelvin equation:

$\lambda=(8\pi\sigma/\rho f^2)^{1/3}$, where f, $\sigma$, and $\rho$ are ultrasonic frequency, surface tension, and liquid density, respectively.

The present invention includes an embodiment having a housing for flowing a gas alongside of at least near the distal end of the last horn stage and then past the nozzle tip to assist in atomization and/or movement of the produced drops. In FIG. 1, a housing 134 is shown in cross section, and comprises means as in U.S. Pat. No. 5,687,905, for flowing gas in directions 136 and/or 137. Supports 135 are optionally provided at the nodes of horn stages for support of the invention nozzle without affecting its operation.

Figure 3:
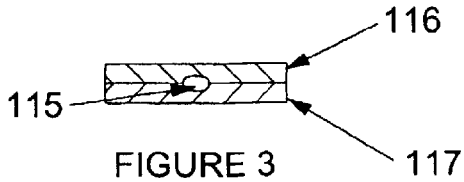
FIG. 3 is cross section AA of FIG. 2.
Figure 6:
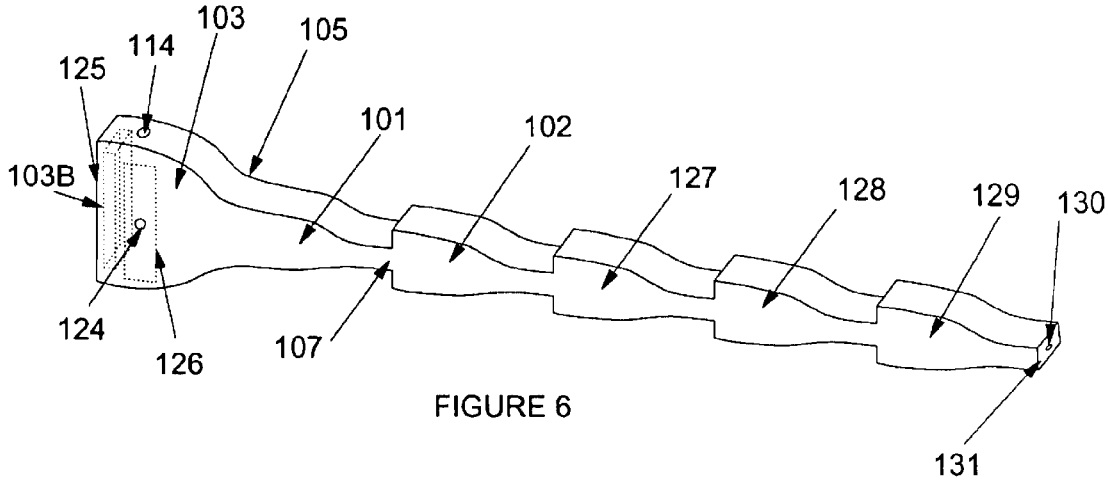
FIG. 6 is a perspective view of a 5 horn stage embodiment of the invention plus a base section for positioning of transducers and introduction of liquids to be atomized.

It is another important embodiment of the present invention to provide for a non-conical cross section for a horn stage as in FIG. 3. This embodiment provides for several important advantages over the prior art. First, the invention nozzle is then capable of being bonded (anodically, adhesively, or otherwise) with piezoelectric transducers to flat sides of base section 103. This provides for location of transducers on the base, embedded within the base section or on a side of a base section. FIG. 6 shows a location zone 126 for the side located transducer. When the invention nozzle comprises two transducers, the first transducer located at the base of base section 103 operates at thickness mode (longitudinal mode) and the second at zone 126 in FIG. 6 operates at shear mode (transverse mode). The first transducer would have a width about equal to the depth of the two pieces of Si-wafer shown in FIG. 3 (with a central channel 115 in oval, square, diamond, rectangular or circular shape) bonded together. The second transducer is of half-wavelength (A/2) design, where A is the acoustic wavelength in the material (PZT in this case), and bonded in zone 126 of FIG. 6 with nodes in different materials, i.e., PZT and silicon, in exact alignment. The first transducer may also serve as an actuator when an RF signal (preferably also at same frequency as the second transducer, i.e., 1.45 MHz for the specific example) is introduced at the transducer electrodes and, thus, forces the liquid to flow axially through the channel 115. The first transducer may also be of A/4 design. The liquid may be pumped into the central channel 115 via the inlet port to conduit 114 when the second transducer is present in zone 126 or via the inlet port 124 when it is absent. As shown in FIG. 6, the invention nozzle comprises in a specific example five Fourier horns of A/2 design with maximum amplitude of vibration occurring at the tip 131 and liquid issuing from opening 130. It focuses the acoustic energy to the tip of the horn where the liquid jet issues from the central channel 115. At resonant frequency (say 1.45 MHz), the second transducer will generate ultrasound that establishes a standing wave at the invention nozzle body with maximum amplitude occurring at the nozzle tip. A capillary wave is established on the liquid as it exits the nozzle tip. Air assistance atomization may be applied according to the teachings of U.S. Pat. No. 5,687,905. Atomization occurs when the amplitude of the capillary wave is too great to maintain wave stability.

Figure 4:
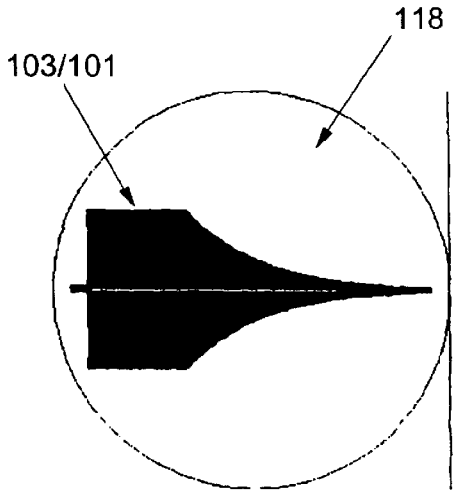
FIG. 4 shows a top view representative of a layout on a silicon wafer of a base section and a single horn stage for fabrication of one half of a single horn stage.

In addition, the flat profile of the device as shown in FIG. 3 now permits manufacture of an ultrasonic nozzle by silicon wafer manufacturing technology. FIG. 4 shows a general silicon wafer 118 with half of a formed base section and single horn stage 103/101 on its surface (each shown as halves 116 and 117 in FIG. 3). Thus, channel 115 can simply be etched into the surface of 101/103 to form half of the required channel 115 when halves 116 and 117 are bonded (anodically, adhesively, or otherwise) to each other. The size of a specific example described for FIG. 6 is relatively small compared to a typical wafer. Therefore, a large number of those nozzles of that specific example may be fabricated from a single wafer. The cost of manufacturing those nozzles is dramatically reduced over the prior art method of casting and machining high alloy metals into a cone shape. In addition, an array of the nozzles may be used to atomize one or more liquids at side by side nozzle tips, with or without gas flow around them, to cumulatively deliver a large drop generation rate for many commercial processes.

Figure 2:
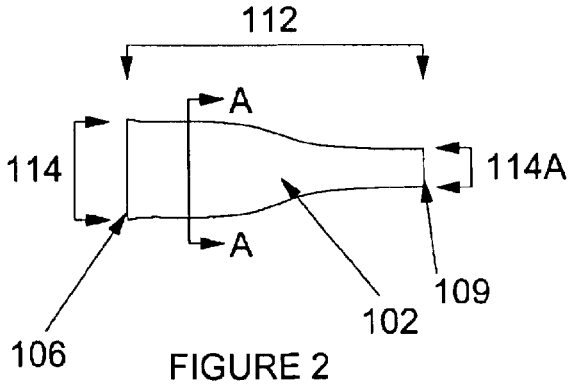
FIG. 2 is a side view of a representative single horn stage.

Referring again to FIG. 1, a section 108 is eliminated in mirror image about the axis of the invention nozzle for each horn stage (in this case horn stage 101). The prior art did not predict that eliminating section 108 mass toward tip 106 and then relatively suddenly increasing in, as for base 107 could cause the unexpected benefit of amplitude multiplication. The generalized horn stages in FIG. 1 are shown in a more preferred form of a Fourier horn as in FIG. 2 with a rectangular cross section from the nozzle axis as in FIG. 3 or in a less preferred form with a conical cross section as in the prior art.

Figure 7:
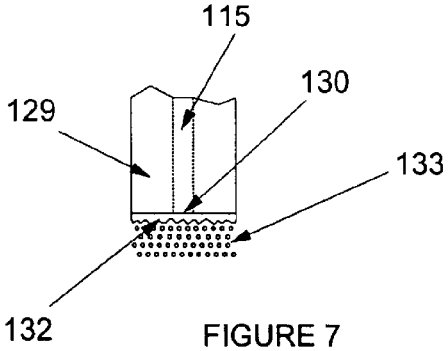
FIG. 7 is a side view of the tip of the invention device in operation atomizing drops at the nozzle tip.
Figure 8:
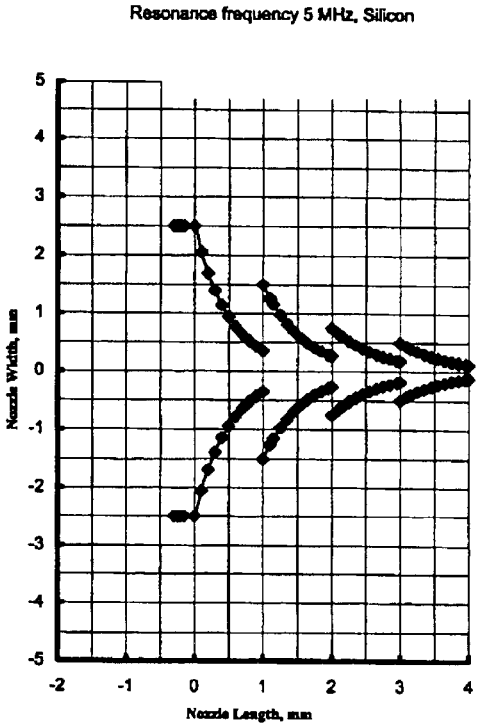
FIG. 8 is a graphical representation of a base section and sequentially narrower base horn stages for a four horn stage embodiment.

Another specific example is now described for transducer 104 operation at a resonant frequency of about 1.45 MHz for the device shown in FIG. 6 with horn stages 101, 102, 127, 128 and 129, connected to a base 125 or side transducer in zone 126 on base section 103. The overall profile thickness of the cross section depth as shown in FIG. 3 is about 1.1 millimeters. The horn stage base length is about 3.13 millimeters, the width is about 1.25 millimeters, and the tip is about 0.4 millimeters. The base 125 of base section 103 is about 3.13 millimeters. The liquid channel 115 entering at top opening 114 and ending in opening 130 is about 0.2 millimeters in equivalent diameter. FIG. 7 shows how liquid layer 132 is maintained in proper operation as a substantially flat layer across the face of tip 131 to generate drops 133.

The length of each horn stage of an A/2 design with an amplification of about two is shown in FIG. 5 for four horn stages. A representative calculation of acoustic wavelengths in silicon and water as well as a transducer thickness for a resonant frequency of 5 MHz are shown as follows:

Acoustic wavelength in Si: (9000 m/s 5×10^6 Hz)=1.8 mm

Half wavelength: 0.9 mm

PZT Transducer: Frequency constant N3t=2000 Hz^(−m)

Thickness @ 5 MHz t=(2000 m/s 5×10^6 Hz)=0.4 mm

Half Wavelength: 0.4 mm

Acoustic wavelength in water: (1500 m/s/5×10^6 Hz)=0.3 mm

Half Wavelength: 0.15 mm

Three Half Wavelengths: 0.45 mm

Six Half Wavelengths: 0.9 mm

Figure 9:
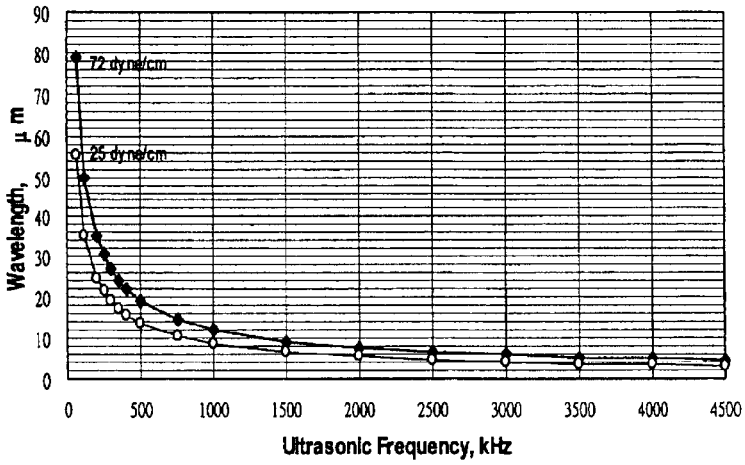
FIG. 9 shows a graph of the relationship of ultrasonic frequency to capillary wave wavelength for two fluids of different surface tension and the clear advantage of operating at above about 1.0 MHz.

FIG. 9 shows the benefits of an invention nozzle capable of operating at greater than 200 kHz ultrasonic frequency. The device is better able to generate small drops with liquids having a relatively wide range of surface tensions. The results are for comparison of two liquids where the drop diameter was shown to be equal to the wavelength of the capillary waves. Other liquids may form droplets smaller than the wavelength of the capillary waves.

The present invention is especially useful in generating sprays for ultrasonic spray pyrolysis. The present inventor has shown that precursor drop size, concentration, and heating rate have significant effects on product particle size and morphology in ultrasonic spray pyrolysis. Large precursor drops (diameter>30 $\mu$m) generated by ultrasonic atomization with nozzle type devices at 120 kHz yielded particles with holes due to high solvent evaporation rate, as predicted by the conventional one particle per drop mechanism. Precursor drops 6–9 $\mu$m in diameter, generated by an ultrasonic nebulizer type device at 1.65 MHz and 23.5W electric drive power, yielded uniform spherical particles 150 nm in diameter under proper control of heating rate and precursor concentration. Moreover, air-assisted ultrasonic spray pyrolysis at 120 kHz and 2.3W yielded spherical particles of which nearly half were smaller than those produced by the ultrasonic spray pyrolysis of the 6–9 $\mu$m precursor drops, despite the much larger precursor drop sizes (28 $\mu$m peak diameter versus 7 $\mu$m mean diameter). These particles are much smaller than those predicted by the conventional one particle per drop mechanism, suggesting that a vapor condensation mechanism may also be involved in spray pyrolysis. Without use of the present invention, nozzle type devices cannot without air assistance produce drops substantially smaller than 30 $\mu$m.

Figure 10:
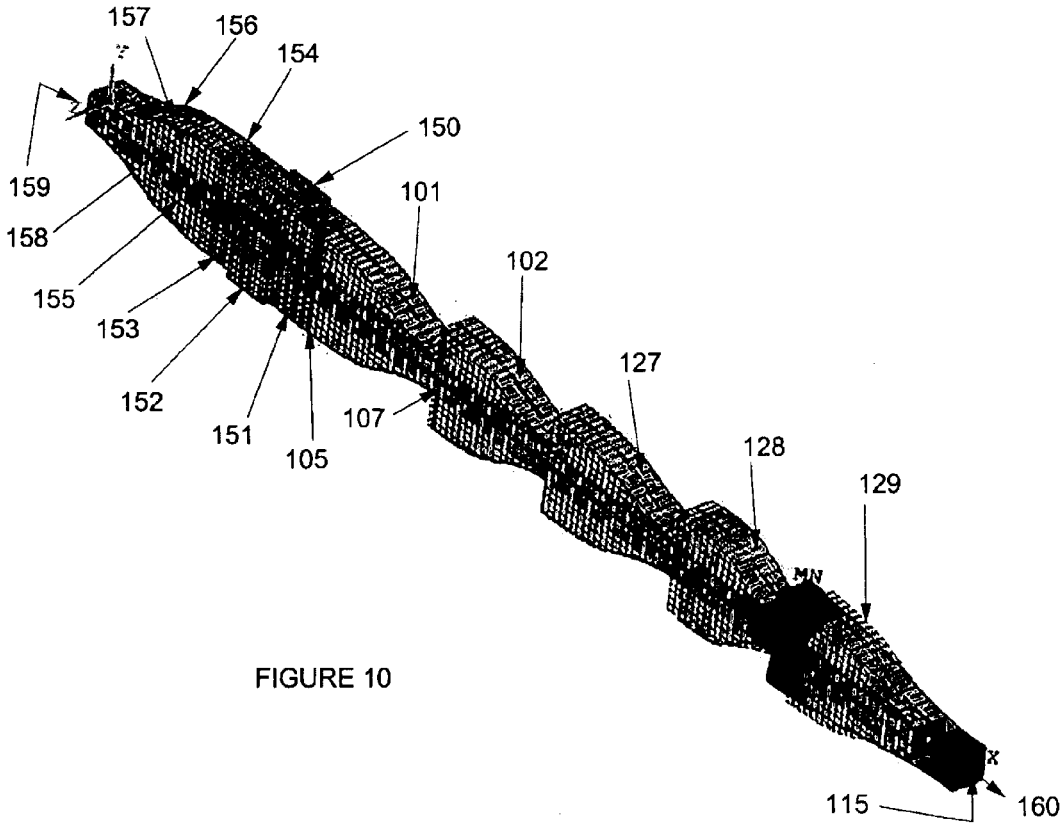
FIG. 10 is a top perspective view of an atomizer with integral pump with five forward horn stages and a single pump horn stage.

FIG. 10 shows Fourier horn stages 101, 102, 127, 128 and 129 essentially as those in FIG. 6. However, base 105 in FIG. 10 is joined integrally and preferably continuously formed with driver stage 151. Driver stage 151 comprises a rectangular zone 153 of essentially half acoustic wavelength and a pair of transducers 150 and 152, one on each side of the rectangular zone 153. Transducers 150 and 152 are adapted to operate substantially as that of transducer 126 in FIG. 6 and other transducers described above to promote atomization of liquid emitting from bore 115 at a terminal end of the forward horn stage 129. Transducers 150 and 152 are integrally and rigidly supported in a rectangular zone 153, which is preferably fabricated according to the above techniques of silicon wafer formation technology. A rearward end 154 of driver section 151 extends continuously to support and connect with a pump horn stages section. A first pump horn stage 155 is essentially of the same dimensions and construction as that of the first forward horn stage 101, except that the orientation is reversed 180 degrees. Bore 115 extends along a common axis shared by all the horn stages and has openings at its ends. The inlet and outlet openings of bore 115 are located as described above. Liquid is drawn into bore 115 in direction 159 and delivered for atomization in direction 160.

Figure 11:
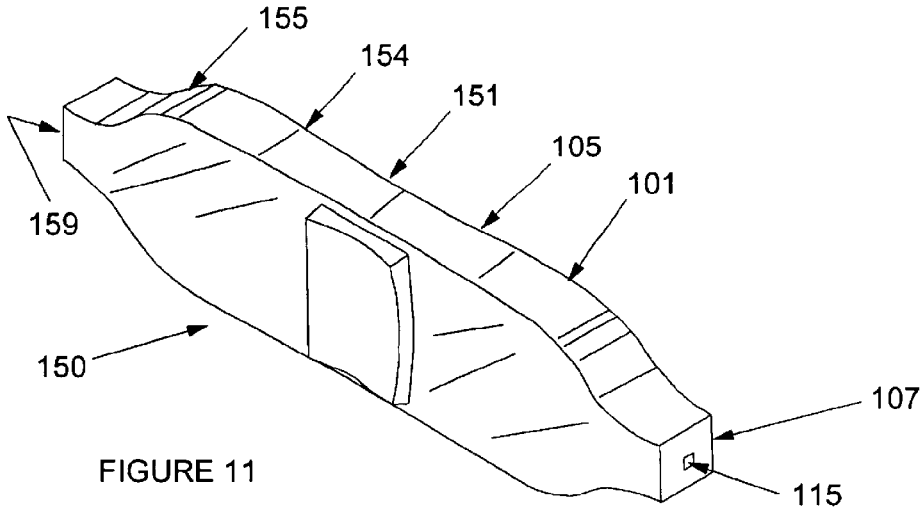
FIGS. 11, 12 and 13 are respectively top perspective, side and top views of a simplest form of the atomizer with integral pump, showing only a single forward horn stage and a single pump horn stage.
Figure 12:
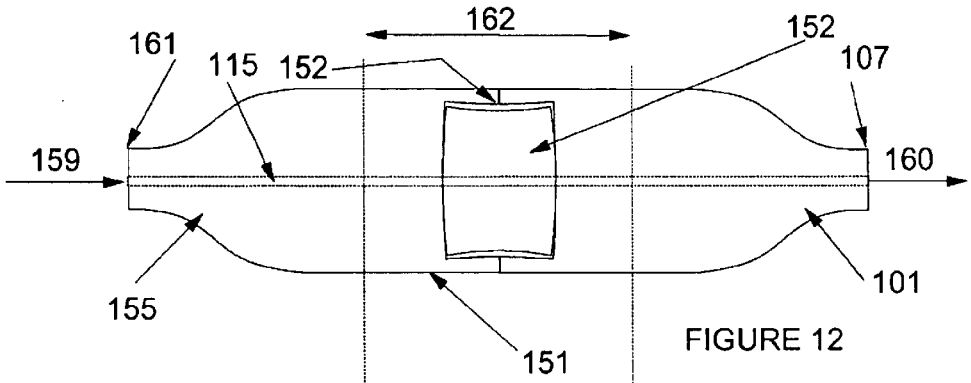
Figure 13:
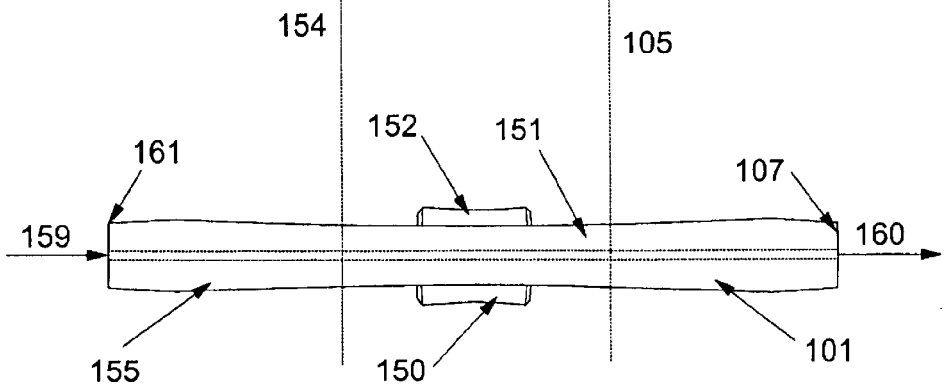

FIGS. 11 through 13 show the aspects of the device of FIG. 10 without horn stages 102, 127, 128 and 129 for ease of understanding. The length 162 of the rectangular zone of the drive section 151 is essentially half acoustic wavelength. Transducers 150 and 152 cause the device of FIG. 10 vibrate longitudinally with maximum amplitudes occurring at the two ends.

Figure 14:
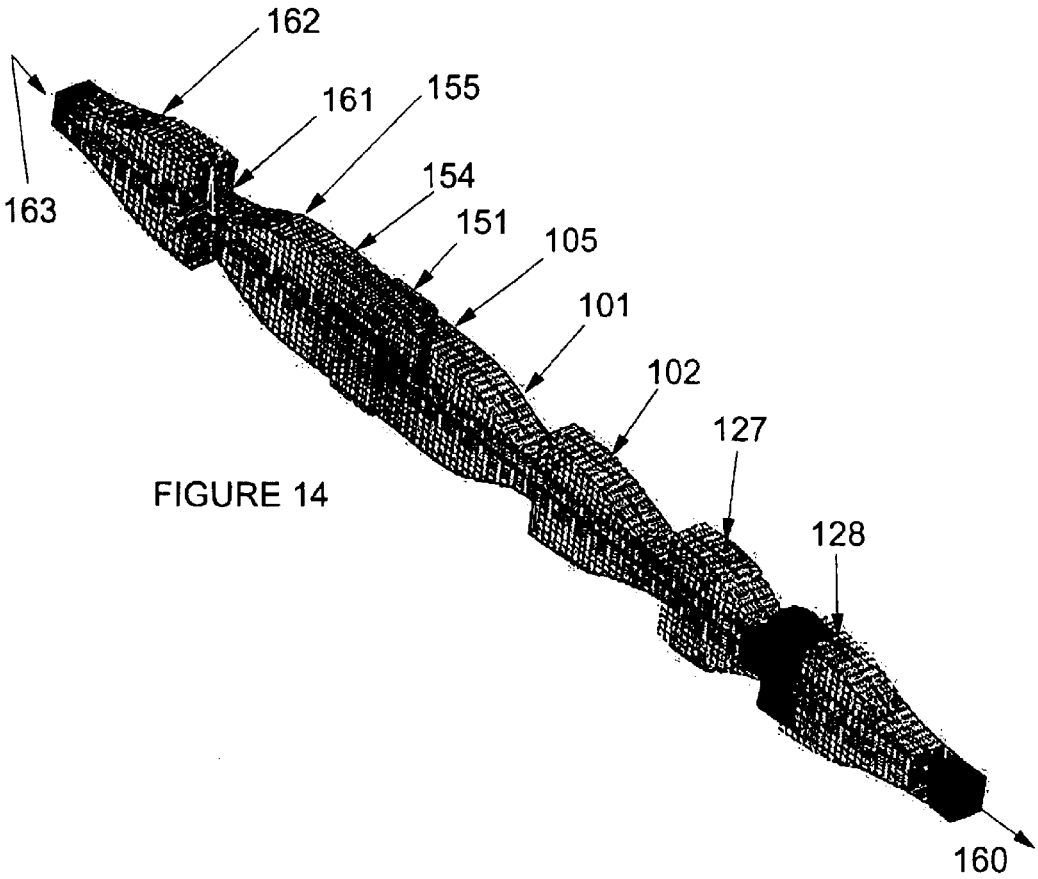
FIG. 14 is a top perspective view of an atomizer with integral pump with four forward horn stages and two pump horn stages.

In an alternate embodiment of the pump horn stages, FIG. 14 shows that surface 161 of pump horn stage 155 is extended continuously to a second pump horn stage 162, where liquid thereby enters bore 115 in direction 163.

Negative pressure developed at the inlet opening depends the liquid, its conditions, and the number of pump horn stages and the power delivered by the transducers 150 and 152. Based on actual experiments using a Sonotek® ultrasonic nozzle with its transducer operated at a frequency of 120 kHz, the negative pressure at the inlet opening was as high as 20 centimeters hydraulic head (water at room temperature) at 1.3 W power. The liquid supply can be a bottle or a pouch of medicine. No check valve is needed in the system. A diffuser may be included in the central channel of the nozzle body to help direct flow, but it is not necessary.

In a preferred form, a user will hold a housing unit which is attached to the nozzle at the nodal lines such as the center of the driver section 151. The user will insert the tip of the pump horn stage section into the surface of a liquid and the tip of the forward horn stages (spray end) into his nose. Subsequently, he turns on the power and can inhale atomized sprays of medicine. Since the nozzle is so small, the device can be of a pocket size.

I claim:

1. A nozzle type device with an integral pump, where the nozzle type device is adapted to atomize liquids at a nozzle tip surface by capillary waves generated in a liquid layer thereon by application of a frequency above about 200 kHz in transducers attached distal to the nozzle tip comprising:

(a) two or more horn stages, each having a central channel defined within a body of the horn stage extending from a base and a horn tip, each horn stage being further adapted to have a length of about one half of the acoustic wavelength at the frequency;

(b) a driver section of about one half of the acoustic wavelength at the frequency with the transducers rigidly attached therein and having a central channel defined within a body of the driver stage extending from a forward end to a rearward end;

(c) a forward horn stage section comprising one or more sequentially connected forward horn stages, with a first base of a first forward horn stage integral with the forward end; and (d) a pump horn stage section comprising one or more sequentially connected pump horn stages, with a first base of a first pump horn stage integral with the rearward end;

(e) the central channels of all the horn stages and the driver section form a continuous channel extending from an inlet opening defined in a free end of the pump horn stage section to an outlet opening defined in a free end of the forward horn stage section.

2. The device of claim 1 wherein the horn stages are Fourier horns.

3. The device of claim 1 wherein the forward horn stage section comprises at least three horn stages.

4. The device of claim 1 wherein the pump horn stage section comprises at least two horn stages.

5. The device of claim 1 wherein a cross section shape of the horn stages is conical.

6. The device of claim 1 wherein a cross section shape of the horn stages is rectangular.

7. The device of claim 6 wherein the horn stages are comprised of two planar halves formed by silicon wafer manufacturing and joined to define the central channel.

8. The device of claim 1 wherein a cross section shape of the central channel is oval, square, rectangular, diamond, or circular.

9. The device of claim 1 wherein the horn stages comprise substantially only silicon, silica compounds or silica composites.

* * * * *